US007318770B2

(12) United States Patent
Jespersen

(10) Patent No.: US 7,318,770 B2
(45) Date of Patent: Jan. 15, 2008

(54) GRINDING WHEEL WITH SAND PAPER ITEMS

(75) Inventor: Poul Erik Jespersen, Roslev (DK)

(73) Assignee: Flex Trim A/S, Roslev (DK)

( * ) Notice: Subject to any disclaimer, the term of this patent is extended or adjusted under 35 U.S.C. 154(b) by 0 days.

(21) Appl. No.: 10/554,647

(22) PCT Filed: Apr. 22, 2004

(86) PCT No.: PCT/DK2004/000274

§ 371 (c)(1),
(2), (4) Date: Oct. 25, 2005

(87) PCT Pub. No.: WO2004/096495

PCT Pub. Date: Nov. 11, 2004

(65) Prior Publication Data

US 2006/0276117 A1 Dec. 7, 2006

(30) Foreign Application Priority Data

Apr. 25, 2003 (DK) ..... 2003 00627

(51) Int. Cl.
*B24D 13/06* (2006.01)

(52) U.S. Cl. ..... 451/469; 451/548

(58) Field of Classification Search ..... 451/466, 451/467, 468, 469, 548, 550, 490, 496
See application file for complete search history.

(56) References Cited

U.S. PATENT DOCUMENTS

| | | | | | |
|---|---|---|---|---|---|
| 2,452,409 | A * | 10/1948 | Wickman | ..... | 451/467 |
| 2,597,421 | A * | 5/1952 | White | ..... | 451/466 |
| 4,377,878 | A | 3/1983 | Pecora | | |
| 4,493,170 | A | 1/1985 | Hanger | | |
| 4,563,839 | A * | 1/1986 | Huppert | ..... | 451/466 |
| 5,119,601 | A * | 6/1992 | Yamashita et al. | ..... | 451/466 |
| 6,808,446 | B1 * | 10/2004 | Mosier | ..... | 451/466 |

FOREIGN PATENT DOCUMENTS

| | | |
|---|---|---|
| EP | 1025958 | 8/2000 |
| EP | 1093885 | 4/2001 |
| JP | 57/001669 | 6/1982 |

* cited by examiner

*Primary Examiner*—Jacob K. Ackun, Jr.
(74) *Attorney, Agent, or Firm*—James Creighton Wray; Clifford D. Hyra

(57) ABSTRACT

The present invention concerns a grinding wheel (1) including a circular wheel that rotates about a central axis and with a surface (2) to which edge parts of a number of sand paper items (3) are fastened, and that the surface (2) has increasing height inwards from a periphery (6) of the surface (2), and that the sand paper items (3) have approximately the same height and are mounted mainly perpendicularly to the surface (2) of the wheel and have approximately radial extension over the greater part of the radius of the surface (2).

8 Claims, 1 Drawing Sheet

GRINDING WHEEL WITH SAND PAPER ITEMS

This application claims the benefit of Danish Application No. PA 2003 00627 filed Apr. 25, 2003 and PCT/DK2004/000274 filed Apr. 22, 2004, which are hereby incorporated by reference in their entirety.

SCOPE OF THE INVENTION

The present invention concerns a grinding wheel including a circular wheel that rotates about a central axis and with a surface to which edge parts of a number of sand paper items are fastened, wherein the surface has increasing height inwards from a periphery of the surface.

BACKGROUND OF THE INVENTION

By grinding with e.g. an angle grinder or a drilling machine, most grinding wheels used are either a flat wheel or a ring wheel, where some force is to be applied in order to hold the grinding wheel stable onto a surface wanted to be ground.

If a flat grinding wheel is used, it is furthermore difficult to grind concave surfaces without leaving distinct grinding marks from the circumferential edge of the grinding wheel.

If a ring wheel is used, where abrasive material is only located from the periphery of the grinding wheel and a distance in on the grinding wheel, for grinding the entire surface there is to be used a number of sweeping movements with the grinding machine, which can be tiresome for the operator who is to hold against the rotating movement of the grinding machine simultaneously with the sweeping movements.

If grinding in recesses/countersinks, it is difficult to use the prior art grinding wheels as it is not possible to move the abrasive parts of the grinding wheel down into recesses/countersinks in a satisfactory way, so that an evenly ground surface is left.

Typically, the operator will try to get the edge of the grinding wheel down into the recesses/countersinks, entailing that the grinding wheel is destroyed and only an uneven grinding of the recess/countersink is achieved.

In U.S. Pat. No. 4,493,170 is shown a grinding wheel with a number of grinding strips. The drawback of this type is that the grinding strip does not cover the entire surface of the grinding wheel, whereby is required a great mobility of the grinding wheel in order to grind a surface.

Furthermore, uneven grinding of the surface occurs, because the shape of the grinding strip/grinding wheel does not compensate for the difference in speed from centre of the grinding wheel and outwards.

In EP 0 566 761 is shown a grinding wheel with a fraction of surfaces inclining out-wards and where lying grinding strips are fitted on this fraction. The drawback of this type is that one is required to tip/turn the grinding wheel in order to utilise the grind-ing strips optimally.

In JP 57-001669 a grinding wheel mentioned in the introduction is disclosed. This grinding wheel is provided with polishing members in slanted position and with sand paper items having an elongate outer edge corresponding to the length of the polishing member.

SUMMARY OF THE INVENTION

Purpose of the Invention

The purpose of the present invention is therefore to indicate a grinding wheel that ensures a stable and uniform grinding, and which is suitable for grinding concave, convex and plane surfaces and recesses/countersinks.

This is achieved with a grinding wheel as described in the preamble of claim 1, where the surface has increasing height inwards from a periphery of the surface, and that the sand paper items have approximately the same height and are mounted mainly perpendicularly to the surface of the wheel and have approximately radial extension over the greater part of the radius of the surface.

Description of the Invention

In order to achieve a more stable and good grinding of a surface, the sand paper items are distributed polarly and evenly around on the surface of the grinding wheel, so that the sand paper items here cover the greater part of the radius of the surface, implying that the greater part of the grinding wheel surface can be used for countergrindring.

The fact that the surface has increasing height inwards from the periphery of the surface implies that the grinding wheel will be felt very stable, as it is the centre part of the grinding wheel that firstly hits the surface wanted to be ground.

The inwards increasing height of the surface will furthermore contribute to compensate for varying speed as the pressure on the grinding surface on a surface will imply a higher centre pressure which thereby outbalances the higher peripheral speed, and an even grinding along the entire grinding piece is thereby achieved.

Around the centre part of the grinding wheel there will no large lateral forces pulling the grinding wheel across the surface, and it will therefore be easy to hold the grinding wheel against the surface.

If larger areas are to be ground, it will furthermore be an advantage that the surface has increasing height inwards from the periphery of the surface, since by contact with a surface, the central part of the grinding wheel is grinding at first, after which the grinding will spread outwards, depending on the pressure applied to the grinding wheel. This implies that it is not necessary with large swinging arm movements in order to grind a surface.

When grinding recesses/countersinks, the central part of the grinding wheel is placed down over recesses/countersinks, implying that the sand paper items towards the centre of the grinding wheel will penetrate down into recesses/countersinks, while the remaining part of the sand paper items will grind the edge areas around recesses/countersinks.

With a grinding wheel according to the present invention, it is possible to grind steel sections (I, II and U) and e.g. to grind countersunk joints in floors.

By the sand paper items being mounted mainly perpendicularly on the surface of the wheel, it is possible to utilise the abrasive part of the sand paper items better than in the case of sand paper items that are placed intentionally with large overlaps. A grinding wheel according to the present invention has thus a longer service life than the commonly known flat or annular grinding wheels.

With an interspace between the sand paper items is furthermore achieved a better grinding effect, as the interspaces contribute to transport abraded material away from the sand paper items, whereby the abrasive parts of the sand paper items are provided a better abrasive effect because they are not filled up with abraded material.

Instead of mounting the sand paper items so that they have radial extension over the greater part of the radius of the surface, the sand paper items can be mounted in relation to the direction of rotation in a rearwards curved arrangement.

In order to make the grinding wheel more flexible and soft in use, the sand paper items are slit inwards towards the surface so that a number of grinding strips are formed. Alternatively, the sand paper items consist of a number of sand paper strips. In both cases it is possible to grind edged, curved surfaces, as grinding strips or sand paper strips may yield and be displaced mutually and thereby better follow the surface.

The grinding ability of the sand paper items may be improved by the sand paper items being supported by a number of support brushes that also are mounted mainly perpendicularly to the surface of the wheel. The support brushes are placed right behind the sand paper items so that they support the sand paper items and thereby keep the abrasive part of the sand paper items in against the surface to be ground.

Furthermore, the support brushes provide that the sand paper items are never bending around the foot and lie back across the surface of the grinding wheel. It is an advantage that there is a certain distance from the surface of the grinding wheel and down to the surface wanted to be ground, so that abraded material can be conveyed away, and to reduce the risk of the surface of the grinding wheel coming into contact with the ground surface.

The number of rows of support brushes may be different depending on how much support the sand paper items are to have. This implies that e.g. there may be three rows of support brushes behind each individual sand paper item.

In an embodiment of the invention, the support brushes have the same height inwards from the periphery of the surface, implying that a uniform polishing pressure is attained.

The grinding wheel can be made so that it is a moulded unit with the sand paper items and the support brushes. This causes that when the sand paper items or the support brushes are worn down, the entire grinding wheel is changed.

Alternatively, the grinding wheel can be designed with separate parts where the grinding wheel is provided with openings for accommodating the sand paper items and/or the support brushes. The openings for accommodating the sand paper items can be undercut channels, and the openings for accommodating the support brushes can be holes. The sand paper items and/or the support brushes may subsequently be glued or moulded securely to these openings.

However, by using the grinding wheel for grinding e.g. edged surfaces, it may occur that some sand paper items are tom apart or worn faster than others. Therefore, it is an advantage that the sand paper items and/or support brushes are adapted for being exchanged individually.

In order to be able to exchange the sand paper items and/or the support brushes, they may be fastened to the surface of the grinding wheel with one of the following solutions:

The sand paper items and/or the support brushes are fastened in a fillet disposed in a preferably radial groove in the surface of the grinding wheel.

The sand paper items are fastened in a preferably radial groove in the surface of the grinding wheel and the support brushes are fastened in holes in the surface of the grinding wheel.

The groove is typically designed with a inwards facing side rendering impossible that the fillet or the edge part of the sand paper items can be released from the groove. In order to ensure that fillets and/or edge part of the sand paper items remains in the groove, the surface of the grinding wheel can be designed with a locking means, so that the fillet or the sand paper items cannot be flung out of the groove due to the centrifugal force when the grinding wheel is rotating.

Such a locking means can be an O-ring placed in a groove in the peripheral edge of the grinding wheel, a spring plate lying under the fillet and thereby retaining the fillet in the groove, or a screw or the like retaining the fillet down into the groove.

In an alternative embodiment of the invention, the sand paper items and the support brushes are secured in a common foot, implying that it is possible to exchange a sand paper item and associated support brushes at once. This foot can furthermore be designed so that it is possible to exchange the sand paper items subsequently and thereby to reuse the foot.

Instead of abrasive paper items and/or brushes that are exchangeably fastened to the surface of the wheel, alternatively there may be used other items together with the grinding wheel. These may e.g. be:

steel brushes, e.g. for cleaning a metal surface
scrubbing brushes, e.g. for cleaning floors
"ondel" brushes, e.g. for rough-grinding surfaces

SHORT DESCRIPTION OF THE DRAWING

The invention is explained in more detail in the following in connection with the drawing, where:

DETAILED DESCRIPTION OF THE INVENTION

Figure 1:
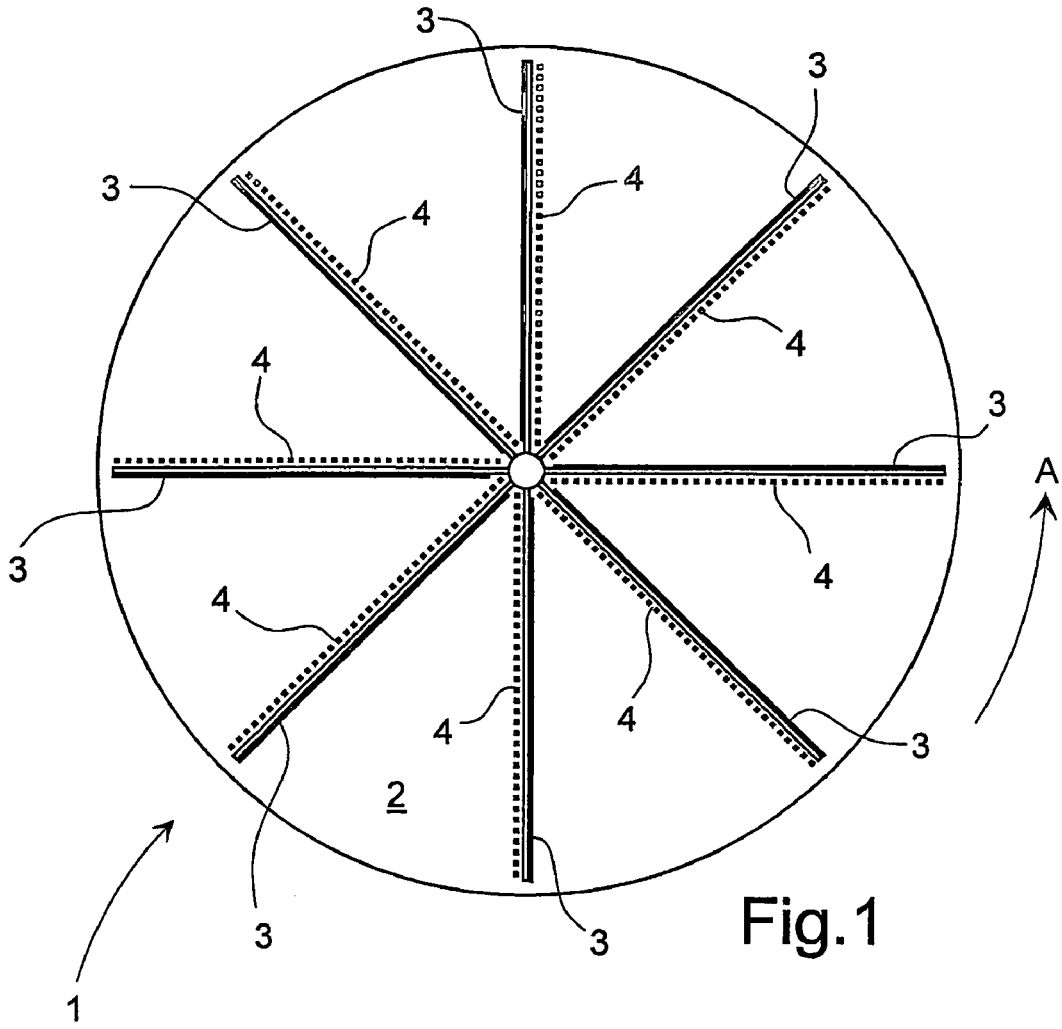
FIG. 1 is a plan view of a grinding wheel according to the invention.

On FIG. 1 is shown a grinding wheel 1 having a surface 2 to which a number of sand paper items 3 are secured and have a radial extension across the greater part of the radius of surface 2. Behind each sand paper item 3, the grinding wheel is provided with a number of support brushes 4.

The number of sand paper items 3 and rows of support brushes 4 may be arbitrary. In the shown embodiment of the invention, there are eight sand paper items with associated single rows of support brushes 4.

The sand paper items 3 are shown here so that they approximately join at the centre of the surface 2, which will be the preferred embodiment of the invention, since there is achieved the best and most uniform grinding when the sand paper items approximately join at the centre.

Figure 2:
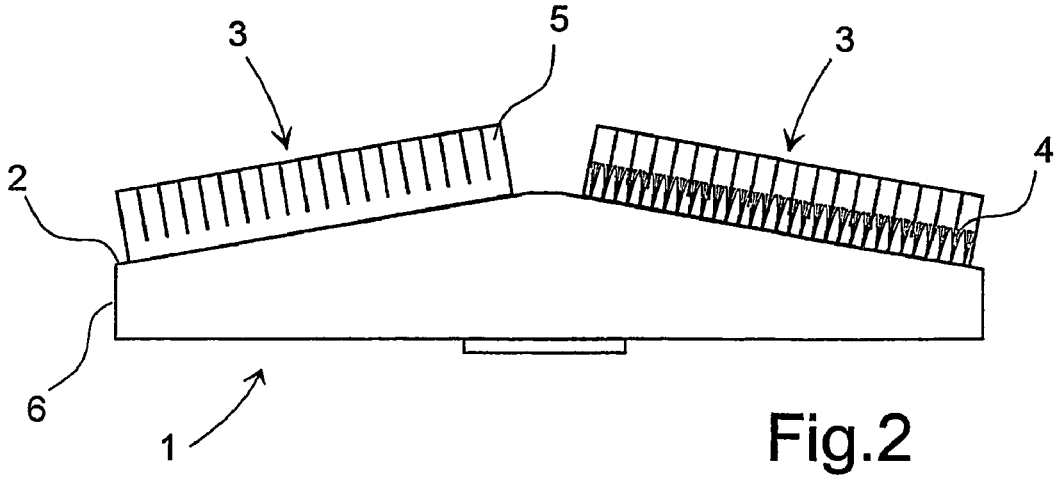
FIG. 2 is a sectional view of a grinding wheel according to the invention.

On FIG. 2, the grinding wheel 1 is shown with two sand paper items 3 which have been slit up so that the sand paper items 3 are divided into a number of grinding strips 5. The sand paper items 3 are fastened to the surface 2 of the grinding wheel 1 which has an increasing height inwards from the periphery 6 of the surface 2. Behind the sand paper items 3 there are provided support brushes 4 having a uniform height, whereby the polishing pressure will become uniform.

The invention claimed is:

1. Grinding wheel including a circular wheel that rotates about a central axis and with a surface to which edge parts of a number of sand paper items are fastened, wherein the surface has increasing height inwards from a periphery of the surface, wherein the sand paper items have approximately the same height and are mounted mainly perpendicularly to the surface of the wheel and have approximately radial extension over the greater part of the radius of the surface, wherein the sand paper items are slit inwards towards the surface and wherein the sand paper items are support by a number of brushes that are also mounted mainly perpendicularly to the surface of the wheel.

2. Grinding wheel according to claim 1, wherein the sand paper items are adapted to be exchanged individually.

3. Grinding wheel according to claim 1, wherein the support brushes are adapted to be exchanged individually.

4. Grinding wheel according to claim 1, wherein the sand paper items and the support brushes are adapted to be exchanged individually.

5. Grinding wheel according to claim 4, wherein the sand paper items and the support brushes are secured in a common foot.

6. Grinding wheel according to claim 1, wherein the sand paper items are fastened in a radial groove in the surface of the grinding wheel.

7. Grinding wheel according to claim 1, wherein the sand paper items are fastened in a radial groove in the surface of the grinding wheel and the support brushes are fastened in holes in the surface of the grinding wheel.

8. Grinding wheel according to claim 1, wherein in order to ensure that the sand paper items cannot be flung out of the groove, the surface of the grinding wheel is designed with a locking means.

* * * * *